United States Patent [19]

DuHamel

[11] 4,160,978

[45] Jul. 10, 1979

[54] CIRCULARLY POLARIZED LOOP AND HELIX PANEL ANTENNAS

[76] Inventor: Raymond H. DuHamel, 12001 Rhus Ridge Rd., Los Altos Hills, Calif. 94022

[21] Appl. No.: 823,218

[22] Filed: Aug. 10, 1977

[51] Int. Cl.[2] ..... H01Q 9/16; H01Q 9/30

[52] U.S. Cl. ..... 343/742; 343/732; 343/737; 343/806; 343/830

[58] Field of Search ..... 343/741, 742–744, 343/731, 732, 737, 895, 792.5, 829, 830, 806

[56] References Cited

U.S. PATENT DOCUMENTS

| | | | |
|---|---|---|---|
| 2,521,550 | 9/1950 | Smith | 343/743 |
| 2,945,227 | 7/1960 | Broussand | 343/731 |
| 3,823,403 | 7/1974 | Walter et al. | 343/744 |
| 4,114,161 | 9/1978 | Shibano | 343/829 |

*Primary Examiner*—David K. Moore

*Attorney, Agent, or Firm*—Flehr, Hohbach, Test, Albritton & Herbert

[57] ABSTRACT

An antenna including a conductive support for supporting a plurality of radiating elements in line next to one another above the conductive support and transmission lines serially connecting the radiating elements. The radiating elements of the loop or helix type with a turn length of substantially one wavelength at the operating frequency and configured to support the equivalent of a ring of current with a traveling wave to radiate circularly polarized radiation.

34 Claims, 19 Drawing Figures

FIG. 6A
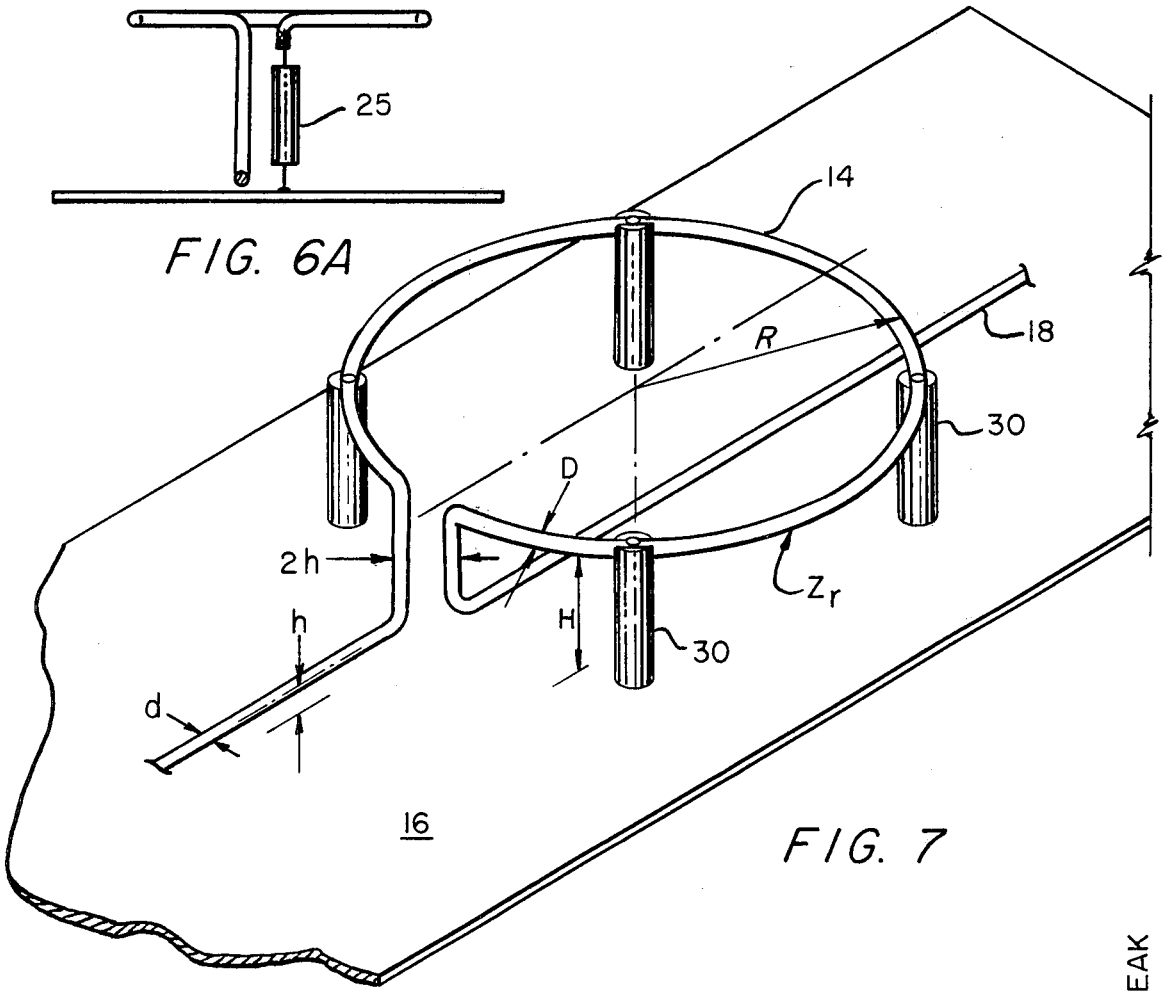
FIG. 7
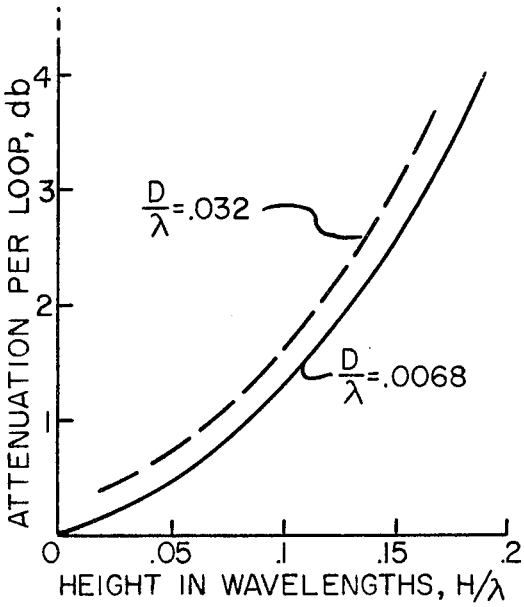
FIG. 8
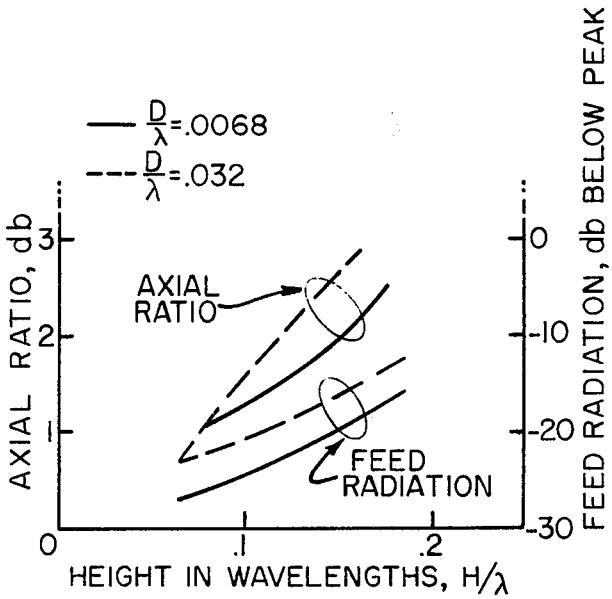
FIG. 9

CIRCULARLY POLARIZED LOOP AND HELIX PANEL ANTENNAS

BACKGROUND OF THE INVENTION

This invention relates to serially connected loop and helical radiating elements placed over a conducting screen or sheet to form panel antennas and more particularly to such antennas for FM and TV circularly polarized broadcast applications.

As used herein, circularly polarized antennas refer to the general class of elliptically polarized antennas with low axial ratio.

Loop antennas with standing wave current distribution have been used for several decades for direction finding applications. The polarization of these antennas is usually vertical with respect to the earth's surface and the azimuthal radiation pattern is a "figure eight."

Other types of loop antennas are those employing traveling waves. It is known that a loop with a traveling wave and one wavelength circumference will produce circular polarization with good patterns. However, in order to achieve a traveling wave in practical manner the loop must be properly terminated as, for example, in a resistor. This results in low efficiency. U.S. Pat. No. 2,247,743 describes a balanced loop having a transmission line connected to one side of the loop and a resistive termination connected at the other side. The traveling wave voltage or current distribution in the loop at mirror image points on each side of the loop have equal magnitudes but are 180 degrees out of phase. The azimuthal pattern of the antenna is unidirectional in the back-fire direction. This type of antenna is for reception of horizontally polarized television signals.

U.S. Pat. No. 2,501,778 describes a traveling wave loop antenna with a resistive termination equal to the surge impedance placed over the earth for the transmission or reception of vertically polarized waves. The diameter of the loop is several wavelengths. For this type of antenna there is little radiation in the broadside direction and the polarization is not circular or elliptical.

Helical antennas have also been used for several decades. Kraus, Proceedings of the IRE, page 263, 1949, describes a single wire helix which can be operated in the circularly polarized normal mode or axial mode. In the axial mode, the turn length is considerably less than a wavelength at the operating frequency so that it produces a doughnut shaped radiation pattern. In the beam mode, the turn length is about one wavelength at the operating frequency and the radiation pattern is endfire.

OBJECTS AND SUMMARY OF THE INVENTION

It is a general object of the present invention to provide an antenna consisting of a multiplicity of serially connected loop or helical antenna elements placed over a ground plane for producing circularly polarized radiation.

It is another object of the present invention to provide a high gain directional or omnidirectional antenna for radiating circularly polarized radiation over moderate frequency bands.

It is a further object of the present invention to provide a circularly polarized broadcast television antenna which improves the quality of television reception.

It is another object of the present invention to provide an antenna including a plurality of loops or helices placed over a ground plane and interconnected by transmission lines such that a traveling wave field distribution exists which allows a low input voltage standing wave radiation and circularly polarized radiation over a moderate frequency range.

The foregoing and other objects of the invention are achieved by an antenna consisting of one or more panel antennas placed around a supporting mast or tower, with each panel antenna comprising a plurality of loop or helix radiating elements with a turn length of substantially one wavelength long at the operating frequency placed over a ground plane and configured such that they essentially support a traveling wave ring of current and connected in series by a transmission line.

BRIEF DESCRIPTION OF THE DRAWINGS

FIG. 6A is a view taken along the line 6A—6A of FIG. 6 showing the resistive termination.

FIG. 7 is an enlarged view of a single loop radiating element showing the various dimensions and spacings to provide a better understanding of the operation of loop radiating elements.

FIG. 8 is a graph showing the attenuation through a loop element due to radiation as a function of height of the loop from the ground plane.

FIG. 9 shows the axial ratio of a traveling wave loop and feed radiation as a function of height above the panel.

DESCRIPTION OF PREFERRED EMBODIMENTS

Figure 1:
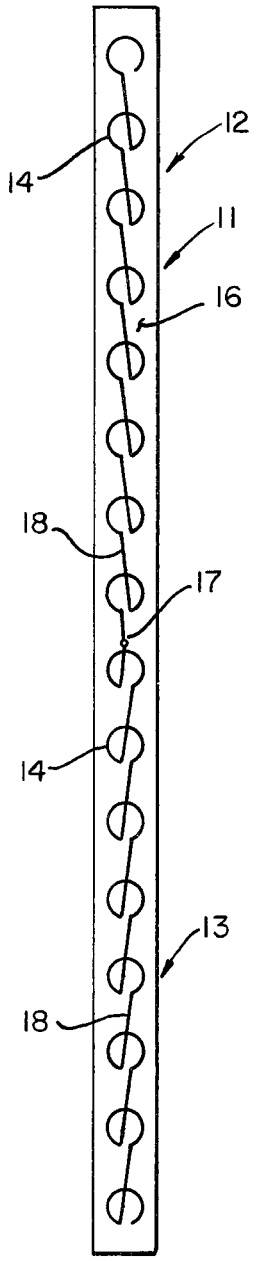
FIG. 1 schematically shows a single panel antenna with loop radiating elements in accordance with the invention.

FIG. 1 is a schematic diagram showing a single panel antenna 11 consisting of two sets 12 and 13 of eight serially connected circular loop radiating elements 14 disposed in cooperative relationship and supported from a ground plane 16. The ground plane comprises conductive material such as a metal plate or screen. One set 12 of loop radiating elements is disposed above feed 17 and the other set 13 of loop radiating elements is disposed below feed point 17. The loop radiating elements are serially connected to one another by means of transmission lines 18 which are connected between the loop elements and to the feed point 17.

Figure 2:
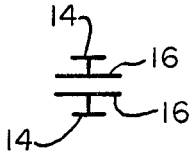
FIG. 2 is a top view of a two panel antenna including panel antennas mounted back to back.
Figure 3:
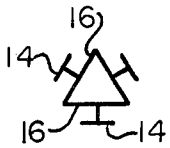
FIG. 3 is a top view of three panel antennas mounted in a triangular configuration.
Figure 4:
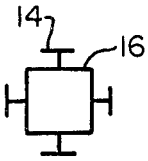
FIG. 4 shows four panel antennas mounted in a square configuration.

Two loop panel antennas may be placed back to back on a tower as schematically shown in FIG. 2. Three loop antenna panels may be placed in a triangular configuration such as shown in FIG. 3. This configuration is particularly adaptable for use with a triangular tower. Four such panels may be placed in a rectangular configuration such as shown in FIG. 4. This configuration is particularly adapted for use in connection with a rectangular tower. The foregoing arrangements are only illustrative. More or less antenna panels may be used and antenna panels may be arranged one above the other to suit particular requirements. By appropriately arranging the panel antennas and exciting the same, it is possible to produce a variety of azimuthal patterns ranging from unidirectional to omnidirectional.

Figure 5:
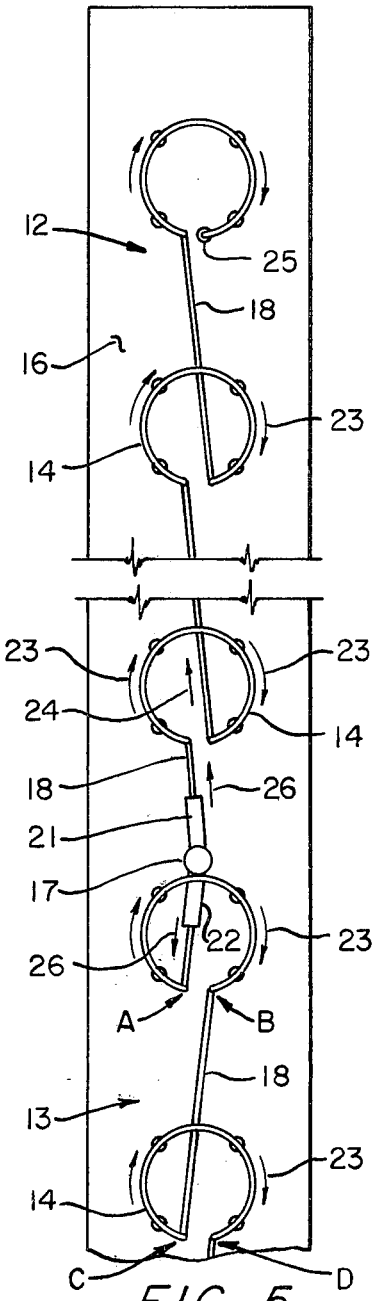
FIG. 5 is an enlarged front view of a single panel showing the coaxial feed, matching transformers, transmissions lines and loop radiating elements.
Figure 6:
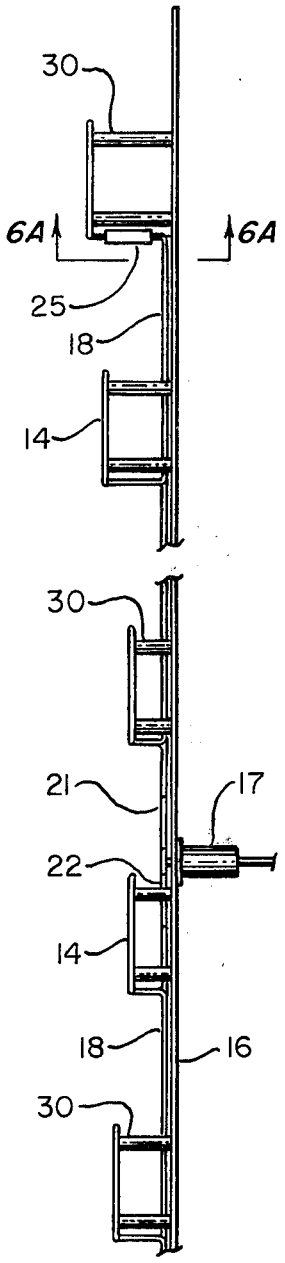
FIG. 6 is a side view of the panel antenna shown in FIG. 5.

FIGS. 5 and 6 show front and side views of a loop panel antenna in more detail. It is to be noted that the ground plane 16 is spaced from and cooperates with the loop radiating elements 14. The loop radiating elements may be formed of a single strand of material which can have a variety of cross sections. The shape may be round, as shown, rectangular, flat, elliptical, etc. Furthermore, the loop radiating element may comprise a number of adjacent strands. The ground plane preferably has a width on the order of one wavelength and a height of several to many wavelengths depending upon the number of loop elements associated therewith. One or more of these antenna panels may be placed on or around a supporting mast or tower and excited to provide a variety of patterns. Several bays of antenna panels may be arranged to form a high gain antenna.

It is noted that the loop elements shown are in the form of circular rings with the plane of the loops substantially parallel to the ground plane 16. The circumference of the loop is slightly less than one wavelength at the mid frequency of the operating band for the antenna. The loop elements are fed through a coaxial feed 17. Quarterwave transformers 21 and 22 connect the center conductor of the coaxial line to the upper and lower transmission lines respectively. Transmission line 18 extends from the transformer to the first loop radiating element and transmission lines extend and interconnect the remainder of the loop radiating elements. The transmission lines connect to one side of each loop element. The energy travels around the loop as indicated by the arrows 23 and then continues along the next transmission line as indicated by the arrow 24 to the next loop. The loops in the upper array 12 and lower array 13 are fed at the same points in relation to the vertical axis, that is they are fed at point A which is substantially six o'clock as viewed in FIG. 5. The energy leaves point B and connects to the next loop at six o'clock. The loop radiating element and transmission line characteristic impedances are chosen so that there are only traveling waves going away from the feed point as illustrated by the arrows 26. For broadside radiation the distance between similar points such as A and C as measured along the loop and transmission line is selected to be substantially equal to two wavelengths at the center frequency of the operating frequency for the panel antenna. The characteristic impedance of these transmission line systems including the loops is in the range of 150 to 200 ohms. The quarter wavelength transformers 21 and 22 connecting the center conductor to the transmission line are used to transform this impedance to about 100 ohms for each of the two sections 12 and 13. The 50 ohm coaxial feed line sees the parallel combination of two 100 ohm loads which is 50 ohms to provide a match.

The radiation from, and hence attenuation through a loop element increases with increasing height above the panel. In order to approximate a uniformly illuminated aperture, it is necessary to increase the height of the loop elements as one progresses away from the feed point 17. This is illustrated in FIG. 6. The end loop element is terminated by a resistor 25, FIG. 6A.

Since each half 12 and 13 of the antenna panel array is an end fed array, its beam will scan with frequency. The direction of the beam is given approximately by $$\theta = \sin^{-1}[2.2(1-(f/fo))] \quad (1)$$

where $f$o is the frequency for broadside radiation and A is the elevation angle as measured from the perpendicular to the ground plane. In order to limit the panel gain loss to 0.9 db at the edges of the frequency band with respect to the gain at $f$o, the half-panel 3 db beamwidth should be at least 3.4 times greater than the beam scan at the frequency band edges. This limits the panel height to about six wavelengths for the lower VHF channels (2–6). For the higher VHF channels the panel height may be on the order of sixteen wavelengths. Other factors may limit the height to values smaller than this.

Two types of radiating elements are disclosed. The first is the single turn loop radiating element discussed generally above. The second is a helical type radiator. It consists of two oppositely wound helices connected in series. Both types will now be described in detail.

FIG. 7 shows a loop radiating element 14, the associated transmission line feed system 18 and the supporting insulators 30. The loop has a radius, height, and rod diameter of R, H and D respectively. The characteristic impedance, $Z_r$, of the loop is approximately the same as that of a straight rod over an infinite ground plane and is given by $$Z_r = 138 \log 4H/D \quad (2)$$

The transmission line over the panel or ground plane consists of a rod of diameter d at a height h. The formula for its characteristic impedance, $Z_t$, is the same as that set forth in equation (2). When the loop is approximately one wavelength in circumference the currents in the parallel rods connecting the loop to the transmission lines will be approximately 180° out of phase under single traveling wave conditions. The characteristic impedance of each rod to ground will be somewhat greater than half the impedance of the parallel vertical rods. Thus if the rods are spaced somewhat less than $2h$, the impedance of each rod, $Z_f$, will be the same as $Z_t$. By setting $Z_t$ equal to $Z_r$ there will be a matched or traveling wave system except for reflections caused by the bends and discontinuities in the feed rods connecting the loop elements to the transmission lines. If these reflections are significant they can be tuned out. Tuning may be accomplished by placing small slugs, dielectric or metal, at appropriate positions along the transmission lines. This loop radiates left hand circular polarization when fed from the transmission line on the left and right hand circular polarization when fed from the transmission line on the right.

Radiation from the vertical feed rods is undesirable since it produces asymmetries in the azimuth pattern and degrades the axial ratio. This radiation may be reduced by adjusting the loop diameter so that the currents at the midpoints of the vertical feed rods are approximately out of phase. This means that the circumference, C, of the loop is less than one wavelength, λ, by the amount H. A theoretical analysis of radiation from a loop with a circumference less than a wavelength but with a traveling wave at free space velocity gave the following result for the axial ratio, $$AR=\lambda/\lambda-H. \quad (3)$$

Thus for a height H of 0.15λ, the axial ratio of the loop radiation is only 1.4 db. Standing waves on the loop and feed lines will usually degrade the axial ratio more than this.

A Wire Antenna Computer Program was used to investigate the properties of loop elements placed over an infinite ground plane. Since the program handled only straight wire sections, the loops were approximated by a hexagonal structure of six rods. This is an adequate approximation to the circular loop. Two vertical rods from the ground plane to the loop formed the feed for the loop. During the studies, the loop radius, height, rod diameter and frequency were varied.

The magnitude and phase of the current distribution on the loop and the vertical feed rods was calculated for various termination resistors between one vertical rod and the ground plane. The termination resistor was first chosen to produce a negligible standing wave on the vertical rod above the resistor. The loop rod diameter was then varied to produce a minimum standing wave ratio of 1.08:1 on the loop. This can be further reduced by using reactive tuning devices, such as small slugs, as discussed earlier.

The theoretical azimuthal patterns for a loop radiating element when mounted on a vertical panel are as follows: The azimuth 3 db beamwidths for vertical and horizontal polarization are 75° and 66° respectively. The axial ratio is less than 4 db for azimuth angles in the range of ±45°. Radiation from the feed produces a slight asymmetry in the horizontal polarization pattern. The feed radiation in the vertical plane was much less. Because of this, different loop and transmission line configurations may give better performance.

FIG. 8 shows the attenuation through a loop as a function of height for two loop rod radii as determined from the computer aided studies. The attenuation is insensitive to loop rod radius. Maximum attenuation of about 3 db are required for a uniformly illuminated array. Thus the loop height will vary from about 0.07λ at the center of the panel to about 0.2λ at the ends.

FIG. 9 shows the axial ratio at the peak of the beam and the feed radiation on the ground plane as a function of loop height. The feed radiation is referenced to the peak gain of the loop. No attempt was made to improve the results for large H/λ. Reducing the loop radius and changing the loop rod diameter would improve the performance.

The current standing wave ratio (SWR) on a loop with a rod diameter of 0.032λ is 1.4:1.0. The axial ratio on the peak of the beam was 3 db for this case. For matching purposes, it was convenient with this computer program to add series capacitors at the junctions of the loop with the vertical feed rods. The SWR was reduced to 1.1 and the axial ratio to 1.4 db by means of 50Ω capacative reactances at the junctions.

As the height of the loops is changed along the length of the panel, either the diameter of the loop rod or the transmission line dimensions should ideally be changed to keep the system matched, i.e. a single traveling wave. This could lead to additional manufacturing costs. A study of practical transmission line and loop dimensions leads to the conclusion that the characteristic impedance of the transmission lines and loops will be in the range of 150 to 200 ohms. Without changing dimensions it was found that the maximum reflection coefficient at the junction of the loop and the vertical feed rods was less than 0.05 for a 2:1 change in loop height. Since this is of the same order as the reflections from bends and discontinuities, it is concluded that it is not worthwhile to change dimensions. This follows from the fact that it will be necessary to "tune out" the reflections from bends and discontinuities anyway, so why not tune out the above reflections in the same manner. In practice it will be necessary to introduce tuning devices in every second or third radiator. The simplest method is to add a lumped shunt capacitance at the correct position on the transmission line.

The loop does not have to be constructed of a circular rod or tube. A conducting strip or several parallel wires may be used to form the loop. If the strip is parallel to the ground plane then the loop becomes an annular ring. In addition, the loop does not have to be circular. Square, hexagonal and octagonal loops will perform in a similar manner.

Although it is not necessary that a single traveling wave exists on the transmission line, the bandwidth of the antenna is enhanced by achieving this condition. The circular polarization is achieved by making the circumference of the loop or the turn length of the helix approximately one wavelength. Near broadside radiation is accomplished by adjusting the interconnecting transmission lines such that the currents at similar points on adjacent loops or helices are in phase.

Figure 10:
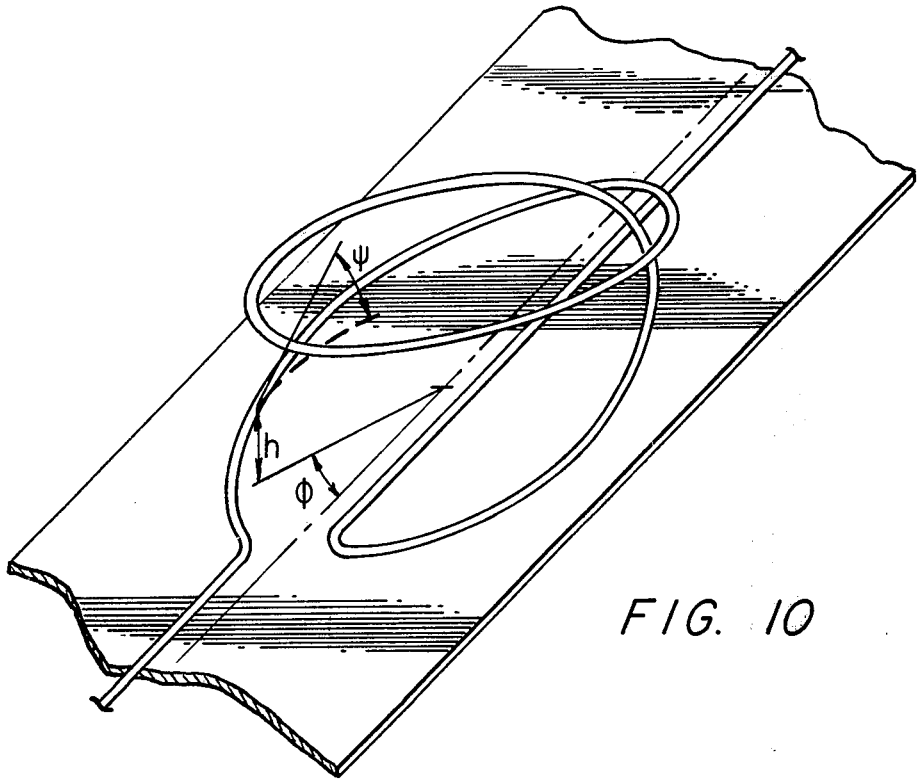
FIG. 10 shows a two turn helical radiating element with the various angles and dimensions used in connection with the explanation of the operation thereof.

FIG. 10 shows a two turn helical radiating element with the transmission lines connected to the lower part of the helices. One turn is left handed and the other is right handed. The total length of the helix is two wavelengths. Thus its performance is approximately equivalent to two traveling wave loops inclined at an angle with respect to each other, each with a circumference of one wavelength. The intent here is to make a gradual transition from the transmission line to the radiating element. Using a constant diameter rod, the upper part of the helix has a larger characteristic impedance than the transmission line. However, the gradual transition acts as an impedance transformer so that there is essentially only a traveling wave. The height, h, of a segment of the helical element is a function of the angle $\phi$. The polarization of the helical radiating element will be approximately circular if h is a predetermined function of $\phi$ for each of the contrawound helices. The reasons for this follow. It is known that a simple loop with a traveling wave current distribution and a circumference of one wavelength produces circular polarization. It is also known that the component of the current in an elemental length of the helix that is parallel to the panel produces a radiation field proportional to sin $(\beta h(\phi))$, where $\beta$ is the free space propagation constant and h is the height of the current element above the panel. Assume that the conductors of a two turn helix lie approximately on the surface of a cylinder of radius r. At an angle $\phi$ there are upper and lower currents, $I_u$ and $I_l$ respectively which contribute to the radiation field. By adjusting the pitch angle $\psi$ which is a function of $\phi$, such that the equivalent total current, $I_t$, $$I_t = I_u \sin(\beta h_u(\phi)) + I_l \sin(\beta h_l(\phi))$$

is approximately independent of $\phi$. To do this accurately one takes into account that the current magnitude in the helix is inversely proportional to the square root of the characteristic impedance of the helical element. In turn the characteristic impedance of the helical element depends on the height of the element above the ground plane. The approximate formula is $$Z_o = 138 \log_{10}(4h/d)$$

where d is the diameter of the rod. Under these conditions it follows that the helical radiating element is an accurate simulation of a traveling wave current loop radiating element. This has been verified by computer studies. It is found that when the above design procedure is followed that the transition from the transmission line to the helical element is gradual enough so that the reflected waves are negligible.

The length of the transmission line connecting adjacent helices is one wavelength at the midband for broadside radiation. The direction of the beam is given by $$\theta = \sin^{-1} 3(1 - L(f/fo) \quad (4)$$

Thus the beam of a half-panel will scan more rapidly with frequency for the helical radiating element than for the loop radiating element.

Figure 11:
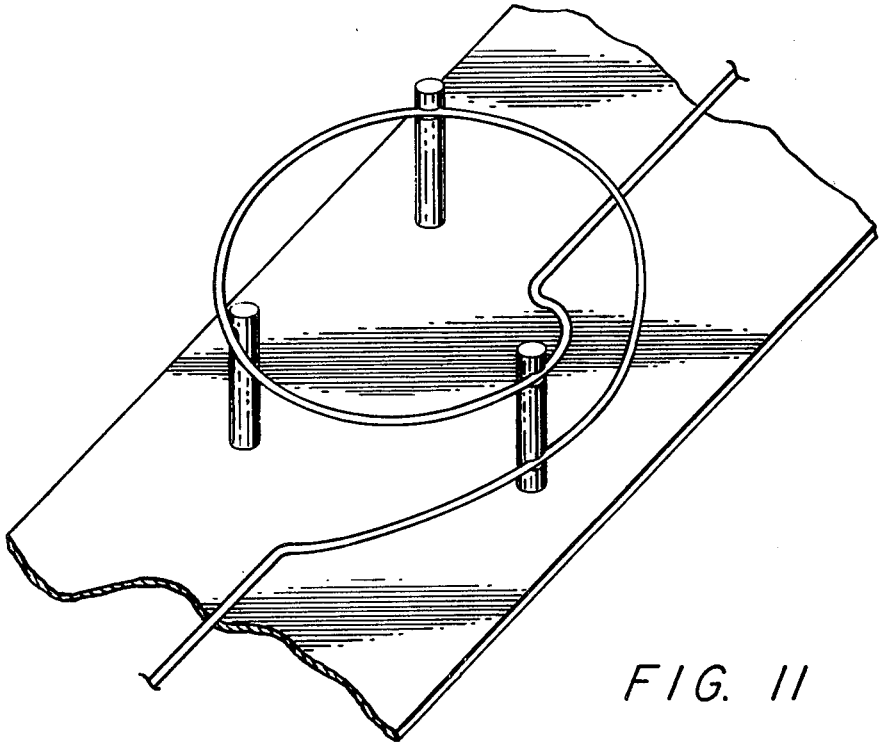
FIG. 11 shows a one and one-half turn helical radiating element which is essentially equivalent to a loop radiating element.

A one and one-half turn helical radiator is shown in FIG. 11. It is equivalent to a series connection of two contra-wound three quarter turn helices. The length of the transmission line between adjacent helices would be a half wavelength for this case. Thus the beam scan rate with frequency would be the same as that for the loop element.

In general an N-turn helical type radiating element may be used where N is a real number, i.e., it is not restricted to the integers. One N/2 turn is left-handed and the other is right-handed. Each N/2 turn helical element is not necessarily a uniform helix, i.e. the pitch angle $\psi$ may vary with distance along the helix but the radius of the helix is constrained such that the turn length is approximately one wavelength. Adjacent helical radiating elements are connected by a transmission line of length such that adjacent helices radiate approximately in phase for broadside radiation and are spaced about one wavelength. The variation of the pitch angle along the helix is adjusted such that a good impedance match is obtained between the transmission line and the helix in order to achieve a traveling wave condition. In addition, the variation of the pitch angle is adjusted so that the radiation from the helix is approximately equivalent to that of a circular loop with a traveling wave current distribution and a circumference of one wavelength in a manner similar to that described for the two turn helix. This technique is considerably different than that of the loop wherein the objective is to keep the characteristic impedances of the transmission lines, feed lines and loop equal.

A third approach would be to vary the diameter of the rod of a helical element so that it is proportional to the height above the panel. This would be equivalent to a uniform transmission line and there would be little trouble in achieving a traveling wave system. This concept could be most easily achieved by using variable width strips rather than a variable diameter rod.

If all of the loops or helices had the same height, there would be an exponential decay of the currents in the radiating elements. This reduces the directivity of a panel compared to that of an array of loops or helices whith equal currents. The directivity can be improved by increasing the height of the loops or helices as one progresses away from the feed point. This increases the radiation from the loop or helix for a given current magnitude. Techniques for designing end-fed arrays to produce a wide variety of aperture distributions are well known, for example, see Jasik, "Antenna Engineering Handbook," McGraw Hill, 1961, pp 16–30 and 16–42. The heights of the loops or helices are adjusted so that the power remaining in the transmission line after the last loop or helix is only one or two percent of the input power to the panel. A resistive termination may be placed on this line to absorb the power with a gain loss less than 0.1 db. FIG. 6A is an end view of the last loop on the top of the panel shown in FIG. 6. The resistor is enclosed in a tubular shield and connected between the end of the loop and the ground plane. If the line is not terminated then a reflected wave will flow back through the loops or helices. It will radiate the opposite sense of circular polarization which degrades the axial ratio. For example, if one percent of the power is reflected, the axial ratio is increased by about 1.6 db.

For the loop radiating element, the radiation from the vertical feed rods is somewhat larger in the plane containing the two rods than the orthogonal plane. When panels are placed around the sides of a tower this feed radiation may cause serious problems in the azimuth pattern. Thus it may be desirable to use the configuration shown in FIG. 12 wherein the two feed rods lie in a vertical plane. The loops are shown connected so that the top and bottom loops produce the same sense of circular polarization. With the configuration shown the loops above the feed point must be fed 180° out of phase with the loops below the feed point. This is accomplished by off-setting the feed point a quarter-wavelength from the midpoint of the transmission line connecting the two central loops. This configuration also reduces the coupling between the loop and transmission line.

Figure 13:
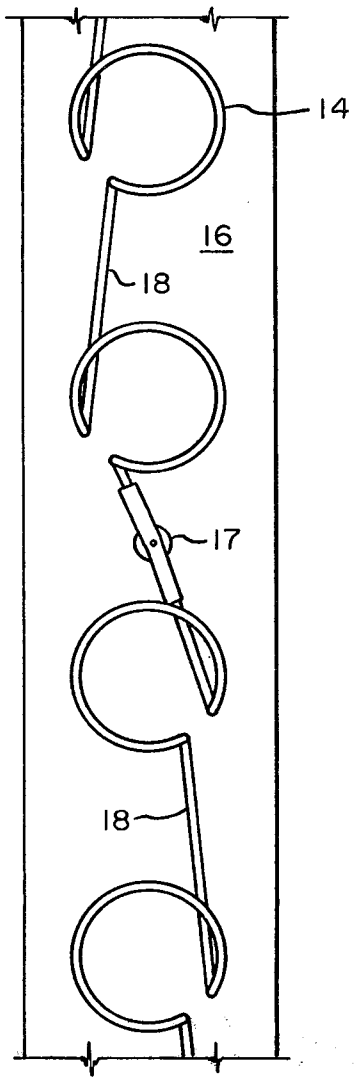
FIG. 13 is a front view of a portion of a loop panel antenna wherein the loops are excited at regions which are at forty-five degrees with respect to the vertical axis of the antenna.

FIG. 13 shows a configuration for obtaining a low VSWR wherein the lower loops are rotated ninety degrees with respect to the upper loops. The feed point is then offset a one eight-wavelength from the midpoint of the transmission line connecting the two central loops. Reflections from the upper and lower half panels will then tend to be out of phase at the feed point.

In general the loops or helices may be rotated by arbitrary amounts with respect to each other. The interconnecting transmission line lengths are adjusted so that the currents at similar points on the loops or helices, such as one o'clock are in phase (for broadside radiation). This is achieved by making the length of transmission line plus the length of loop or helix element between similar points equal to an integral number of wavelengths.

The loops and rods described may be supported from the ground plane by dielectric spacers.

Coaxial lines may also be used to connect adjacent loops or helices. However, for 150Ω lines, the diameter of the inner conductor is about 1/12 that of the outer conductor. If this is too small to handle the power or the physical requirements, then quarter wave transformers may be placed between the loops or helices to transform to a lower impedance for the coaxial line.

TABLE I

Nominal Dimensions of Panel Antennas with Loop Radiators
All dimensions are in inches.

| Ch. No. | Wave Lgth. | Panel Wdth. | Loop Dia. | Loop Hgt. | Loop Rod Dia. | TL Type* | TL Dia. | TL Hgt. | TL $Z_t$ |
|---|---|---|---|---|---|---|---|---|---|
| 4 | 176.3 | 114 | 50 | 17 | 2.5 | 1 | .25 | 1.7 | 198 |
| FM | 120.5 | 78 | 34.5 | 12 | 2.5 | 1 | .25 | 1.2 | 177 |
| 10 | 60.6 | 39 | 17.4 | 6 | 1.5 | 2 | .25 | — | 166 |
| 20 | 22.9 | 15 | 6.6 | 2.3 | .75 | 2 | .25 | — | 150 |
| 60 | 15.7 | 10.5 | 4.5 | 1.6 | .5 | 2 | .25 | — | 150 |

TL Type 1. Rod over flat ground plane
2. Rod in trough

*High impedance coaxial lines may also be used.

Figure 14:
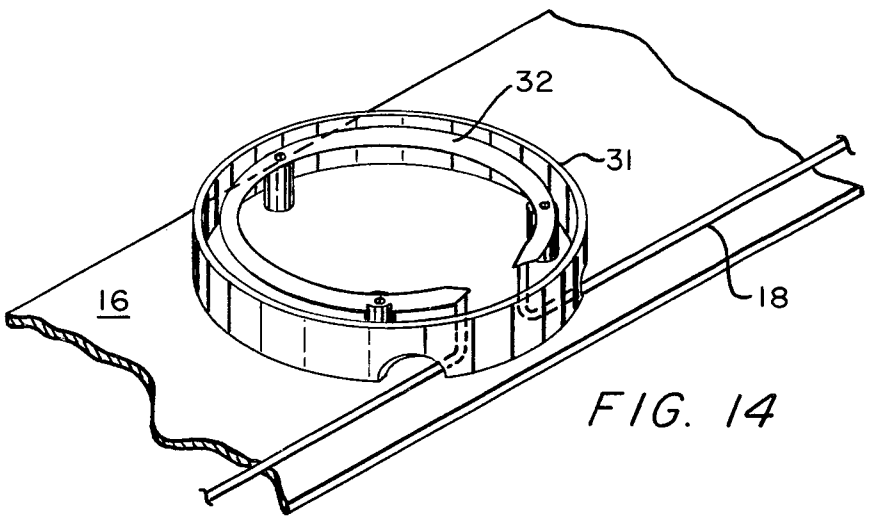
FIG. 14 shows a loop radiator with a short conducting cylinder placed around the loop to provide a cavity for control of the radiation pattern.
Figure 15:
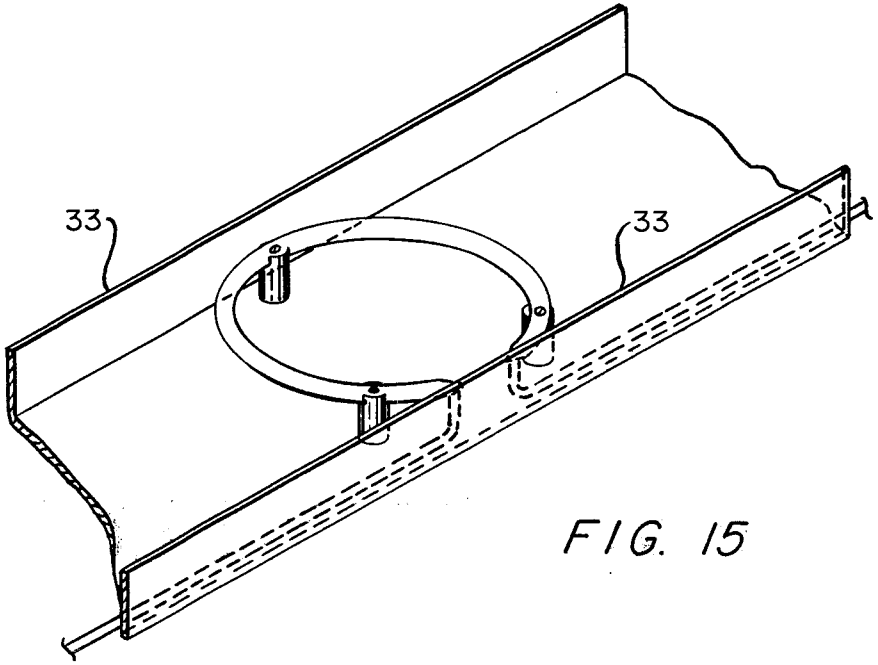
FIG. 15 shows a loop placed on a panel with side walls used to control the azimuthal radiation pattern.

FIG. 14 shows a cylindrical cavity 31 placed around a loop radiating element 32. In this case the loop is formed by an annular disk cut out of a metal sheet. The purpose of the cylindrical cavity is to equalize the beamwidths for vertical and horizontal polarization. For triangular tower mounting the cavity diameter should be approximately 0.55 wavelengths. For rectangular towers the diameter should be about 0.8 wavelengths. Square, hexagonal or octagonal cavities would produce similar results. Walls 33 may be placed on the panel as shown in FIG. 15 to provide control of the beamwidths similar to that obtained with the cylindrical cavities.

Table I lists nominal dimensions of FM antennas and TV antennas for various channels. The panel width should be greater than λ/2 but is not critical. For Table I a panel width of about 0.65λ was chosen. For center fed panels, the panel height may vary from about six to twenty wavelengths depending upon the bandwidth and beam-width requirements. End fed panels would obviously be half these lengths. The loop circumferences are approximately λ−H where H is the height of the loop above the panel. The loop height depends upon the required attenuation which depends upon the panel height. The loop height will usually vary from about 0.1 to 0.2λ.

Figure 16:
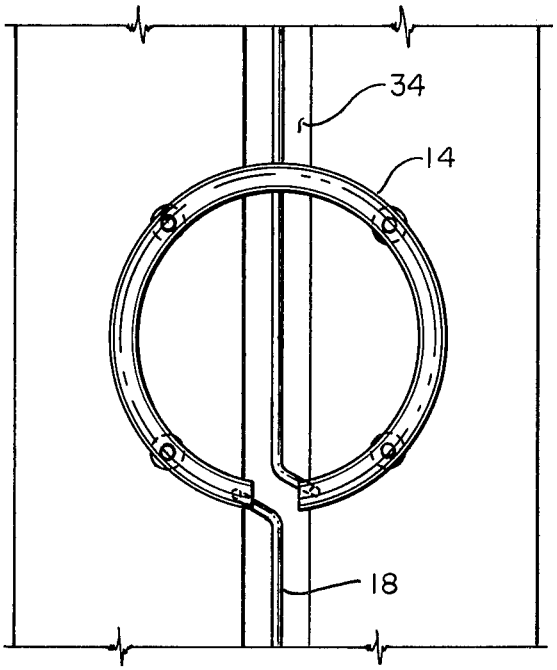
FIG. 16 is an elevational view of a loop with an alternate transmission line configuration wherein the transmission line is placed in a rectangular trough to reduce radiation from discontinuities.
Figure 17:
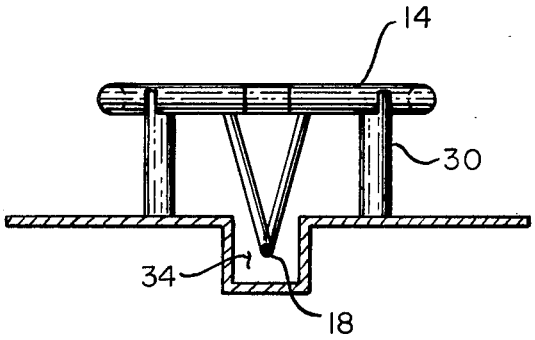
FIG. 17 is an end view of the antenna shown in FIG. 16.

The loop rod diameter determines the characteristic impedance of the loop. For reasonable rod diameters this impedance will usually be greater than 140 ohms. For a transmission line consisting of a rod over the panel, the height of the rod should be about one-tenth the height of the loop in order to keep the transmission line radiation at a low level. For channels 7 and higher this would imply quite small heights and thin wires for the transmission lines. A practical alternative is to use a trough type transmission line as illustrated in FIGS. 16 and 17. The trough 34 can also be of triangular type. With trough widths and depths of two inches and a rod diameter of ¼ inch, the characteristic impedance is in the range of 150 ohms. The trough configuration keeps the transmission line radiation at a low level. The transmission line characteristic impedance is set equal to the loop characteristic impedance. Metal strips may be used for the loops and/or transmission lines rather than rods.

Figure 12:
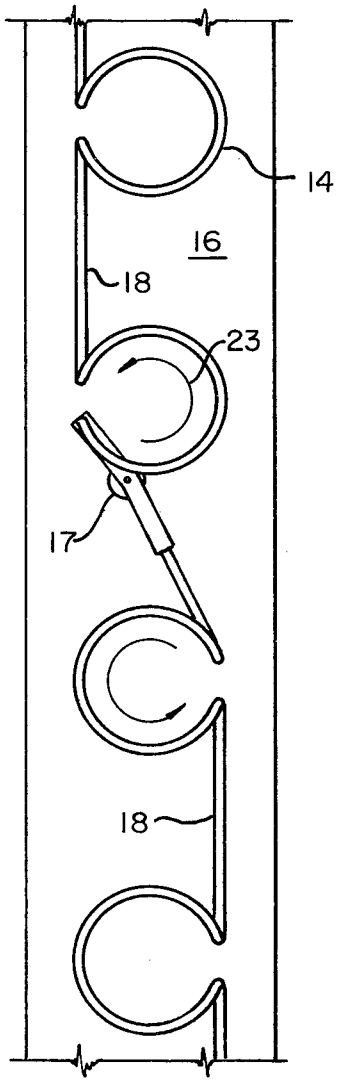
FIG. 12 is a front view of a portion of a loop panel antenna wherein the loop elements are excited at the left or right sides by the transmission lines.
Figure 18:
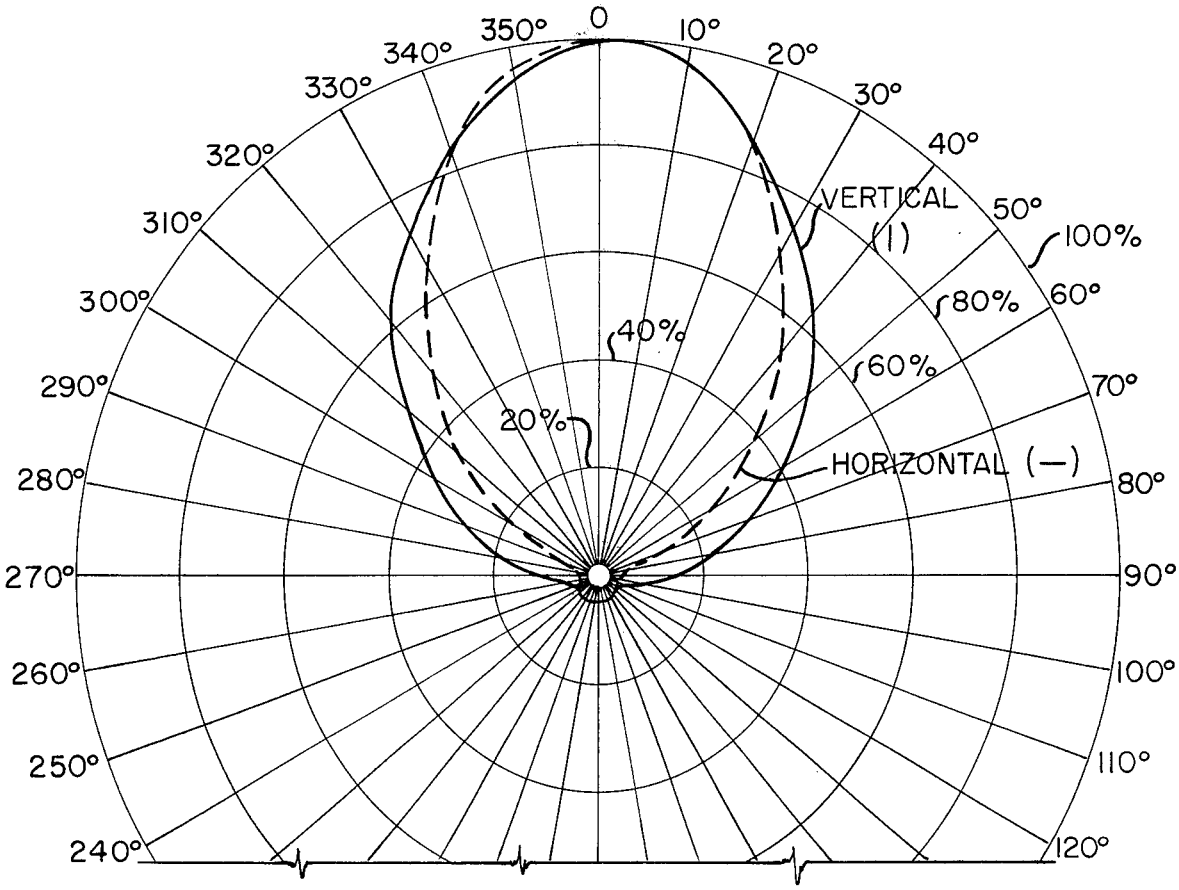
FIG. 18 shows the azimuth radiation patterns for a loop panel antenna consisting of a single center-fed panel with eight loops.

FIG. 18 shows measured azimuth patterns for a loop-panel antenna consisting of a single center-fed panel with eight loops. The loop construction was like that of FIG. 14 where wide strips were used. The loops were positioned as shown in FIG. 12. The array of loops was designed according to the theory described above for the frequency of 492 Mhz. The beamwidths for vertical and horizontal polarization are 64° and 57°. The two patterns are nearly identical which is necessary for circular polarization radiation. The axial is less than 2.5 db for all azimuth angles within 45° of the beam peak. The elevation patterns had a 6° beamwidth and first side lobes of −14 db which are quite close to the predicted results.

What is claimed is:

1. A circularly polarized antenna assembly comprising a conductive plane, a plurality of adjacent radiating elements each comprising at least one open radiating loop all portions which lie substantially in a plane, means for supporting each of said radiating elements above said conducting plane in line next to one another with the plane of said at least one loop being substantially parallel to the conducting plane, transmission line means connecting said radiating elements in series from one opened end of the loop to an adjacent loop and means for feeding one end of said series of radiating elements, the impedance of said transmission lines and radiating elements selected so that the radiating elements each support a traveling electrical wave equivalent to a traveling wave on a ring to produce circularly polarized radiation.

2. A circularly polarized antenna as in claim 1 wherein said loops have a circumference of approximately one wavelength at the operating frequency of the antenna assembly.

3. A circularly polarized antenna as in claim 1 wherein the distance between similar points on the series connected radiating elements measured along the transmission lines and radiating elements is an integral number of wavelengths at the operating frequency of the antenna to produce substantially broadside radiation.

4. A circularly polarized antenna as in claim 3 wherein said loops having a circumference of approximately one wavelength at the operating frequency of the antenna assembly.

5. A circularly polarized antenna as in claim 1 wherein said radiating loop is composed of two N/2 turn helices, with a turn length of approximately one wavelength, wound in opposite senses and connected in series where N is the number of turns, a number greater than one.

6. A circularly polarized antenna as in claim 5 wherein said radiating loop is composed of two single turn helices with a turn length of approximately one wavelength wound in opposite senses and connected in series.

7. A circularly polarized antenna as in claim 5 wherein said radiating loop includes two three-quarter turn helical elements with a turn length of approximately one wavelength wound in opposite senses and connected in series.

8. A circularly polarized antenna as in claim 5 wherein the distance between similar points on the series connected radiating elements measured along the transmission lines and radiating elements is an integral number of wavelengths at the operating frequency of the antenna to produce broadside radiation.

9. A circularly polarized antenna assembly as in claim 1 wherein each of said radiating elements is disposed within a cavity.

10. A circularly polarized antenna element as in claim 1 wherein said ground plane includes upturned sides.

11. A circularly polarized antenna as in claim 1 wherein said means for supporting said radiating elements supports the elements at increasing height from the ground plane away from the feed point.

12. A circularly polarized antenna array including a plurality of antenna assemblies as in claim 1 arranged in line to radiate a predetermined elevational pattern.

13. A circularly polarized antenna array including a pair of antenna assemblies as in claim 1 placed back to back.

14. A circularly polarized antenna array including three antenna assemblies as in claim 1 disposed to form a triangle.

15. A circularly polarized antenna array including four antenna assemblies as in claim 1 placed in a rectangular configuration.

16. A circularly polarized antenna array including a plurality of antenna assemblies as in claim 3 arranged to radiate a predetermined horizontal pattern.

17. A circularly polarized antenna array including a pair of antenna assemblies as in claim 3 placed back to back.

18. A circularly polarized antenna array including three antenna assemblies as in claim 3 disposed to form a triangle.

19. A circularly polarized antenna array including four antenna assemblies as in claim 3 elements placed in a rectangular configuration.

20. A circularly polarized antenna comprising a plurality of antenna assemblies as in claim 3 placed one above the other.

21. A circularly polarized antenna assembly including two antenna assemblies as in cliam 1 extending in line away from one another and common means for feeding the said two antenna assemblies.

22. A circularly polarized antenna assembly including two antenna assemblies as in claim 3 extending in line away from one another and common means for feeding said two antenna assemblies.

23. A circularly polarized antenna assembly including two antenna assemblies as in claim 5 extending in line away from one another and common means for feeding said two antenna assemblies.

24. A circularly polarized antenna assembly comprising a conductive plane, two series of radiating elements, each series including radiating elements supported above said conductive plane in line next to one another, each of said radiating elements comprising a loop lying in a plane which is substantially parallel to the conductive plane, said two series of radiating elements having one end adjacent to one another with the other end of each series extending away from said adjacent ends, said radiating elements being at increased heights away from said adjacent ends, transmission line means connected to feed one end of the first of said radiating elements at said one end of each series and transmission line means interconnecting the loops in each series so that the radiating elements are connected in series along the transmission lines, said transmission line means and radiating elements selected so that the impedance of said transmission line means and radiating elements support selected so that the radiating loops support a traveling wave to produce circularly polarized radiation.

25. A circularly polarized antenna as in claim 24 in which the other end of the last in each series is terminated to ground by a resistor.

26. A circularly polarized antenna as in claim 24 wherein said loops have a circumference of approximately one wavelength at the operating frequency of the antenna assembly.

27. A circularly polarized antenna as in claim 24 wherein the distance between similar points on the series connected radiating elements measured along the transmission lines and radiating elements is an integral number of wavelengths at the operating frequency of the antenna to produce broadside radiation.

28. A circularly polarized antenna array including a plurality of antenna assemblies as in claim 5 arranged in line to radiate a predetermined elevation pattern.

29. A circularly polarized antenna as in claim 5 wherein said means for supporting said radiating elements supports the elements at increasing height from the ground plane away from the feed point.

30. A circularly polarized antenna as in claim 5 wherein each of said radiating elements is disposed in a cavity.

31. A circularly polarized antenna as in claim 5 wherein said ground plane has upturned sides.

32. A circularly polarized antenna assembly including two antenna assemblies as in claim 5 extending in line away from one another and common means for feeding adjacent ends of said antenna assemblies.

33. A circularly polarized antenna as in claim 24 wherein said radiating elements are composed of two N/2 turn helices, with a turn length of approximately one wavelength, wound in opposite senses and connected in series where N is the number of turns, a number greater than one.

34. A circularly polarized antenna as in claim 24 wherein each of said radiating elements is disposed in a cavity.

* * * * *